US005686145A

United States Patent [19]

Akasaka

[11] Patent Number: 5,686,145

[45] Date of Patent: Nov. 11, 1997

[54] METHOD OF FORMING A PROTECTIVE FILM ON A COATED SURFACE AND APPARATUS FOR CARRYING OUT THE SAME

[76] Inventor: Kensaku Akasaka, c/o Honda Giken Kogyo, Kabushiki Kaisha, Sayama-Factory, 10-1 Shinsayama 1-chome, Sayama-shi, Saitama-ken, Japan

[21] Appl. No.: 640,926

[22] PCT Filed: Dec. 20, 1995

[86] PCT No.: PCT/JP95/02612

§ 371 Date: Apr. 30, 1996

§ 102(e) Date: Apr. 30, 1996

[87] PCT Pub. No.: WO96/19296

PCT Pub. Date: Jun. 27, 1996

[30] Foreign Application Priority Data

Dec. 22, 1994 [JP] Japan ..... 6-320631
Dec. 22, 1994 [JP] Japan ..... 6-320636

[51] Int. Cl.[6] ..... B05D 3/04; B05C 11/06

[52] U.S. Cl. ..... 427/284; 427/287; 427/348; 118/63; 118/304; 118/323

[58] Field of Search ..... 427/348, 284, 427/287; 118/63, 304, 323, 324

[56] References Cited

U.S. PATENT DOCUMENTS 3,953,626 4/1976 Suzuki et al. ..... 118/63
5,397,606 3/1995 Jeffs ..... 118/63

FOREIGN PATENT DOCUMENTS 487 398 9/1975 Australia .
4224678 1/1994 Germany ..... 427/348
6-438 1/1994 Japan ..... 118/63

OTHER PUBLICATIONS

Abstract of Japan 6–142604 (May 24, 1994).

*Primary Examiner*—Katherine A. Bareford
*Attorney, Agent, or Firm*—Merchant, Gould, Smith, Edell, Welter & Schmidt

[57] ABSTRACT

A coating nozzle (3) movable in a horizontal direction perpendicular to an advancing direction of a vehicle body (1) drops or trickles a strippable paint linearly along one side of the periphery of an area to be protected, and an air blow-off unit (4) blows off air (F) at a predetermined angle against a surface to which the strippable paint is applied, whereby the strippable paint is spread over the area to be protected, and when the thus spread strippable paint becomes dry, it forms a protective film. The strippable paint is prevented from adhering to a portion other than the area to be protected, and the protective film of strippable paint has a uniform thickness.

17 Claims, 5 Drawing Sheets

METHOD OF FORMING A PROTECTIVE FILM ON A COATED SURFACE AND APPARATUS FOR CARRYING OUT THE SAME

This is a national stage application of PCT/JP95/02612, filed Dec. 20, 1995.

TECHNICAL FIELD

The present invention relates to a method and apparatus for forming a protective film on a coated surface to temporarily protect the same, and more particularly to such a method and apparatus in which a liquid strippable paint is applied onto a coated surface of an entire car, for example, to form a protective film for temporarily protecting the coated surface while the entire car is transported.

BACKGROUND ART

One known method of temporarily protecting a coated surface of an entire car during the delivery or shipping of the entire car is disclosed, for example, in Japanese Patent Laid-Open Publication No. 6-142604, entitled "Method of Temporarily Protecting a Film of Coating on Vehicle Body". In this disclosed method, an area to be protected, such as the hood, roof or trunk of a vehicle body is coated along its peripheral edge with a strippable paint of a fixed width applied by a roller or a brush, and before or after such coating, the strippable paint is coated by spraying over an area which is narrower than the area to be coated and hence bordered by the roller- or brush-coated strippable paint so that the roller- or brush-coated paint layer and the spray-coated paint layer overlap with each other.

According to this method, since the strippable paint is spray-coated on an area narrower than the area to be protected, the efficiency of the coating work can be improved with the resulting simplification of following or subsequent working processes attained.

In the prior art, however, since dust of the paint being spayed scatters widely, the overlapped coating portion formed by coating the strippable paint with the roller or the brush must have an increased area which will increase the cost.

Furthermore, since the paint dust scattering about beyond the overlapped coating portion may adhere to a portion other than the area to be protected, an appropriate masking process and a process for inspection and correction or mending become necessary. As a result, an increase in cost is not avoidable.

In the case of an article having a large area to be coated, such as an automobile, the strippable paint as it is coated by the roller or the brush tends to become irregular in thickness, resulting in rupture or removal of a protective film of the strippable paint.

With the foregoing drawbacks in view, an object of the present invention is to provide a method and apparatus for forming a protective film on a coated surface with a uniform thickness and at a high coating efficiency while preventing a strippable paint from adhering to a portion other than an area to be protected.

DISCLOSURE OF THE INVENTION

The above object can be achieved, according to the present invention, by a method of forming a protective film on a coated surface for temporarily protecting the same, characterized by comprising the steps of: trickling or dripping a strippable paint onto the coated surface linearly along one side of the periphery of an area to be protected; and blowing the air from the above obliquely against the surface to which the strippable paint is applied, for causing the strippable paint to spread over the area to be protected and then eventually become dry to form a protective film.

In the case where the strippable paint has a high viscosity or is quick at dry, the blow-off air is preferably humidified air.

It is further preferable that dehumidified air is blown against the strippable paint after it is spread over the area to be protected. The dehumidified air thus blown after the humidified air ensures further spreading of the strippable paint and accelerated drying of the strippable paint.

The angle at which air is blown is in the range of 55° to 65°, and preferably 60°.

It is preferable that the method further includes the step of coating the strippable paint on with a roller or a brush along the periphery of the area to be protected so as to form an overlap between a coating portion formed by this roller- or brush-coating step and a coating portion formed by said blowing-step. With the overlapped coating portion thus formed, the aesthetical appearance of a visual boundary portion is improved.

Preferably, the air is blown in such a direction that stream or air blown from left and right sides of a central portion are directed inwardly to cross streams of air blown from the central portion. This arrangement is advantageous because the strippable paint is prevented from flowing outward beyond the area to be protected.

An apparatus of the invention for carrying out the method comprises: a coating nozzle movable in a horizontal direction perpendicular to an advancing direction of an article to be coated for delivering a strippable paint onto the article; an air blow-off unit for blowing air at a predetermined ejection angle in the range of 55° to 65°, and preferably 60°, against the article; a longitudinally movable frame structure carrying thereon the coating nozzle and the air blow-off unit and movable in a direction parallel to the advancing direction of the article; and a vertically movable frame structure carrying thereon the longitudinally movable frame structure and movable in a direction of the height of the article.

It is preferable that the air blow-off unit is composed of a central block, a left block and a right block each having at its bottom a plurality of air nozzles, and that streams of air blown from the left and right blocks are directed inwardly to cross streams of air blown from the central block.

The air blow-off unit has an open delivery end preferably composed of a multiplicity of aligned holes.

The coating nozzle moves in the horizontal direction perpendicular to the advancing direction of the article to be coated while trickling or dripping the strippable paint linearly onto a coated surface. The air blow-off unit ejects or blows air in a direction opposite to the advancing direction of the article and at the predetermined ejection angle with respect to a coated surface to spread out the trickled paint within the area to be protected.

Then, the longitudinally movable frame structure carrying thereon the coating nozzle and the air blow-off unit is moved in the direction opposite to the advancing direction of the article. Thereafter, the coating nozzle moves again in the horizontal direction while trickling the strippable paint on the coated surface. The trickled paint is subsequently spread out within the area to be protected by blowing air from the air blow-off unit onto the coated surface at the predetermined angle and in the direction opposite to the advancing direction of the article.

The foregoing cycle of operations is repeated until the strippable paint is coated uniformly over the entire area to be coated.

In the case of an air blow-off unit which is composed of an air nozzle for ejecting or blowing humidified air and an air nozzle for ejecting or blowing dehumidified air, even when the strippable paint used is of the type having a high viscosity or becomes dry easily, the humidified air forces the trickled paint to spread over the coated surface within the area to be protected, and subsequently the dehumidified air effects further spreading and thinning of the strippable paint while promoting drying of the strippable paint.

BEST BODE FOR CARRYING OUT THE INVENTION

The present invention will now be described below in greater detail with respect to one embodiment shown in the accompanying sheets of drawings.

Figure 1:
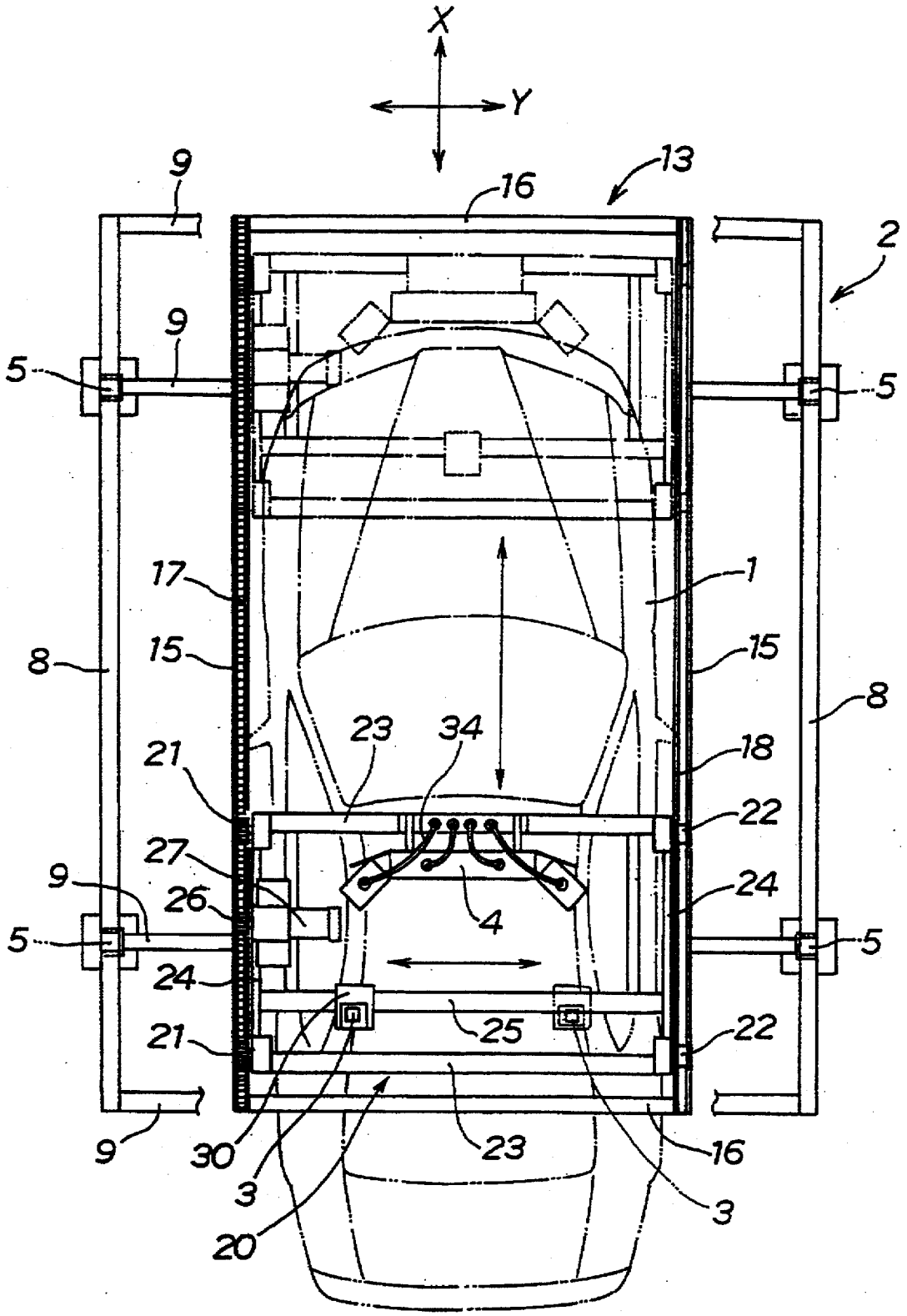
FIG. 1 is a plan view of a protective film forming apparatus for carrying out a method of forming a protective film on a coated surface according to the present invention.
Figure 2:
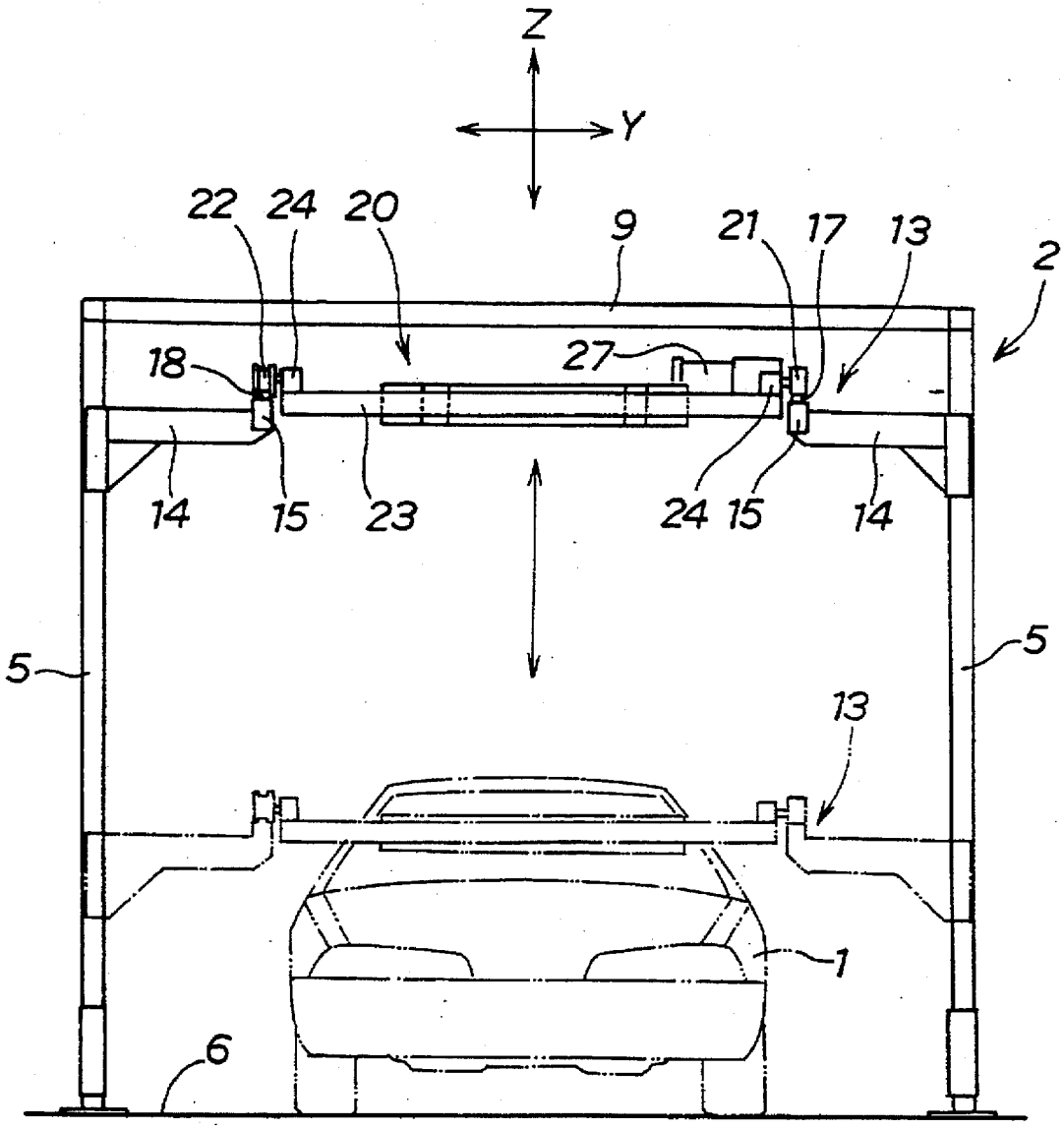
FIG. 2 is a front elevational view of the protective film forming apparatus for carrying out the method of forming a protective film on a coated surface according to the present invention.
Figure 3:
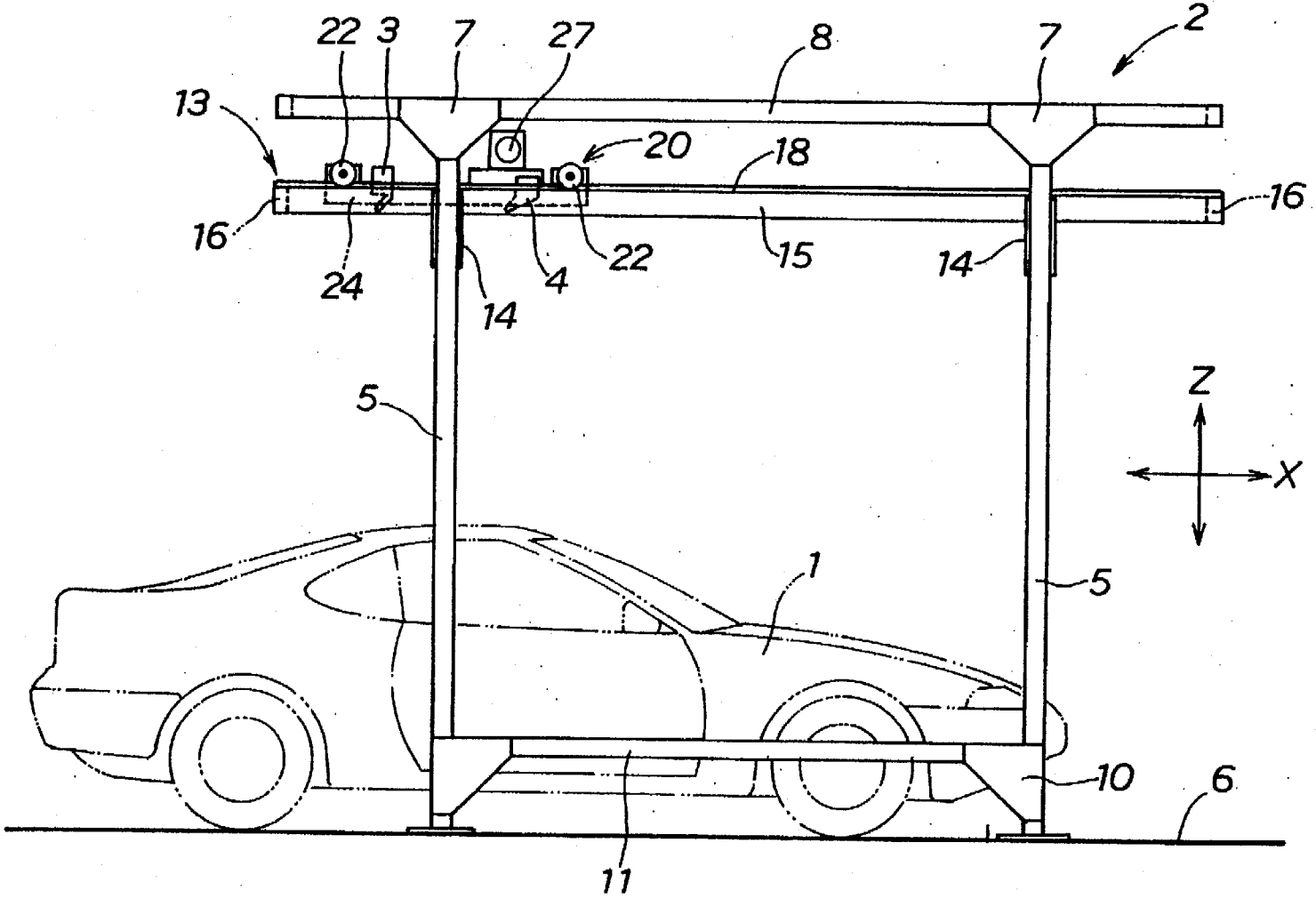
FIG. 3 is a side view of the protective film forming apparatus for carrying out the method of forming a protective film on a coated surface according to the present invention.

A protective film forming apparatus for carrying out a method of forming a protective film on a coated surface according to the present invention is shown in FIGS. 1 through 3. The protective film forming apparatus comprises a portal or gantry-like framework 2 of a size large enough to permit passage therethrough of a vehicle body 1 while being conveyed by a conveyor (not shown), a coating nozzle 3 for dropping or trickling a strippable paint down onto a coated surface of the vehicle body 1 to be protected, and an air blow-off unit 4 for blowing or ejecting air against the strippable paint trickled from the coating nozzle to spread the strippable paint over an area to be protected. In FIGS. 1–3, an orthogonal coordinates system (X, Y, Z) is shown.

Figure 4:
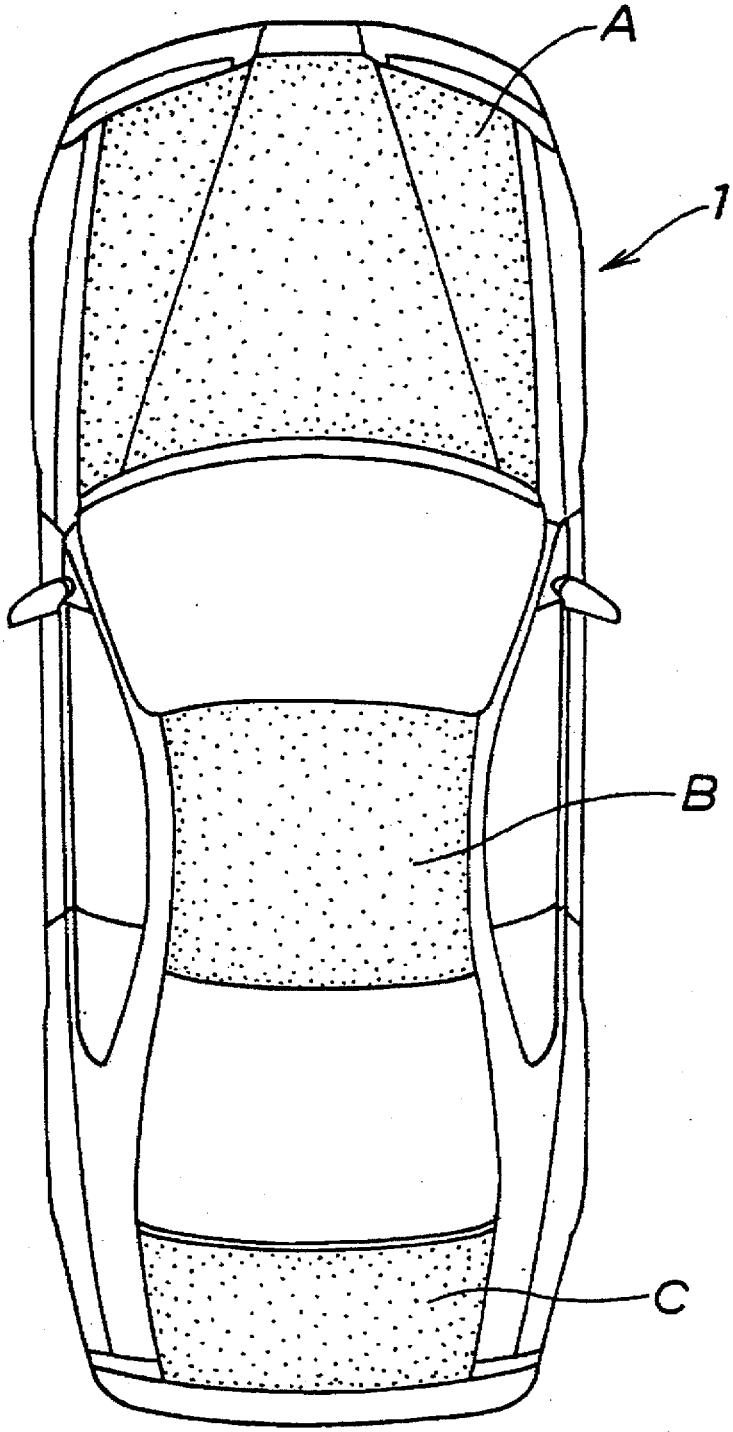
FIG. 4 is a plan view of a vehicle body showing various areas over which a protective film is to be formed.

The coated surface of the vehicle body 1 includes areas or portions over which a protective film is to be formed, these portions being composed, for example, of a hood A, a roof B and a trunk lid C, as shown in FIG. 4.

The strippable paint is preferably of the type which, after it is formed into a coated film (protective film), can exhibit excellent impact resistance and abrasion resistance and possess a water resistance and an oil resistance, and which, when it is to be removed, can be readily stripped or peeled off as a single sheet of film. The strippable paint is selected, for example, from a polyvinyl chloride paint, a vinyl emulsion paint, a water-based emulsion paint and a synthetic latex.

The portal framework 2 is composed of four rectangular column-like vertical frames 5 upstanding from a floor 6, two horizontal side frames 8 extending along an advancing direction (X-axis direction) of the vehicle body 1 and each attached to the upper ends of two adjacent ones of the vertical frames 5 via attachment members or brackets 7, and four horizontal cross frames 9 extending in a direction (Y-axis direction) perpendicular to the advancing direction (X-axis direction) of the vehicle body 1 and provided such that two of the cross frames 9 are each attached to the upper ends of two adjacent ones of the vertical frames 5 and the remaining two cross frames 9 are each attached to the front ends or the rear ends of the side frames 8. As shown in FIG. 3, two additional side frames 11 extending horizontally in the X-axis direction are attached to respective lower portions of the vertical frames 5 via attachment members or brackets 10 so as to reinforce the vertical frames 5.

A vertically movable frame structure 13 is coupled with the rectangular column-like vertical frames 5 so that it is movable in a vertical direction (Z-axis direction).

The vertically movable frame structure 13 is composed of four guide members 14 vertically movably engaged with corresponding ones of the column-like vertical frames 5, two frames 15 spanning in the X-axis direction over respective ends of the guide members 14, and two frames 16 each interconnecting the front ends or the rear ends of the frame 15 in the Y-axis direction.

One of the frames 15 has a rack 17 longitudinally disposed thereon, as shown in FIG. 2, and the other frame 15 has a rail 18 longitudinally disposed thereon.

Thus, the vertically movable frame structure 13 is movable in the vertical or Z-axis direction by means of a drive means and a guide means (neither shown) while it is held in engagement with the column-like vertical frames 5.

The vertically movable frame structure 13 is also engaged with a longitudinally movable frame structure 20 which is movable in the X-axis direction and equipped with the coating nozzle 3 and the air blow-off unit 4.

The longitudinally movable frame structure 20 is composed of two frames 23 extending in the Y-axis direction and each having a pinion 21, at one end, and a roller 22, at the opposite end, two frames 24 interconnecting adjacent ends of the frames 23 in the X-axis direction, and a rail member 25 spanning between the frames 24.

A motor 27 is fixedly mounted on one of the frames 24 and has a pinion 26 attached to its rotating shaft.

The pinions 21, 26 are held in mesh with the rack 17 and the rollers 22 are held in rolling engagement with the rail 18, so that when the motor 27 is energized, the longitudinally movable frame structure 20 is movable in the X-axis direction on and along the vertically movable frame structure 13.

The coating nozzle 3 is secured to a nozzle base 30 and connected to a paint supply device or unit (not shown) provided for supplying a strippable paint to the coating nozzle 3, the nozzle base 30 being movable horizontally in the Y-axis direction. The nozzle base 30 has a self-propelling or mobile structure which is movable at a desired speed on and along a portion of the longitudinally movable frame structure 20, viz., the rail member 25 by the action of a drive means (not shown) equipped with a servo motor and a speed reducer.

Figure 5:
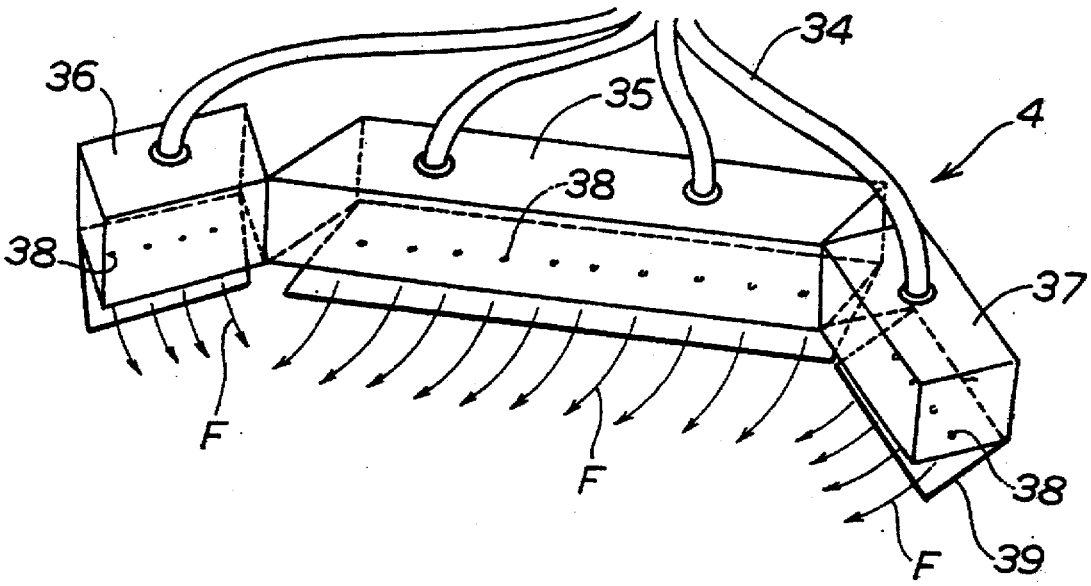
FIG. 5 is a perspective view of an air blow-off unit.

The air blow-off unit 4 is secured to one of the frames 23 and connected to an air supply device or unit (not shown) provided for supplying air to the air blow-off unit 4 via hoses 34. As shown in FIG. 5, the air blow-off unit 4 is composed of three rectangular boxes, namely, a central box 35, a left box 36 and a right box 37. The boxes 35, 36, 37 each have at its bottom wall a multiplicity of aligned air blow-off holes or nozzles 38 so formed as to open in the Z-axis direction. The air blow-off holes 38 have a diameter of about 0.6 mm and are able to blow or eject air at a speed of about 25 m/sec.

By virtue of the multiplicity linearly arranged air nozzles 38, the air blow-off unit 4 is able to create closely juxtaposed streams of air resembling a planar stream of air created by a single slit.

Figure 6:
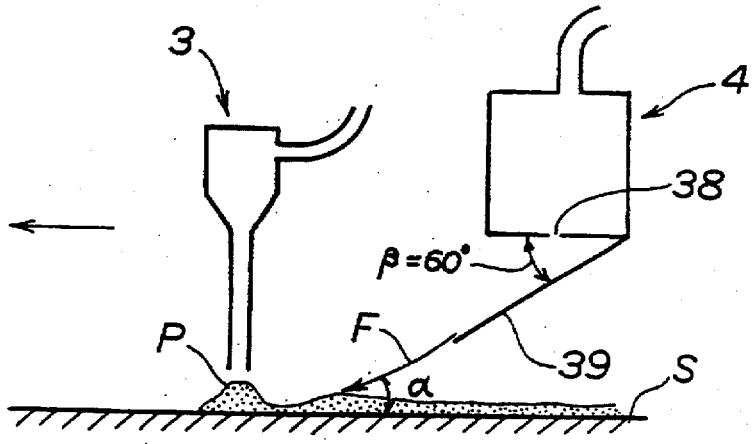
FIG. 6 is a diagrammatical view showing the positional relationship between a coating nozzle and the air blow-off unit.

As shown in FIGS. 5 and 6, the air blow-off holes 38 are open or directed at an angle substantially perpendicular to a coated surface S of the vehicle body 1. In view of the orientation of the air nozzles, the boxes 35, 36, 37 are each provided with a plate member 39 which has a setting angle $\beta$ variable to adjust or regulate the air ejection angle $\alpha$ at a desired value. By adjusting the setting angle $\beta$ of the plate member 39, the angle at which streams of air F ejected from the individual air blow-off holes 38 hit or impinge against the plate member 39 can be changed so as to adjust the air ejection angle $\alpha$ at the desired value.

The setting angle $\beta$ of the plate member 39, which is defined between the plate member 39 and the bottom wall of the air blow-off unit 4 including the air blow-off holes 38, is preferably in the range of 55° to 65°. The setting angle $\beta$, if greater than 65°, can only provide a narrow visual boundary and, if smaller than 55°, tends to cause a scattering of air. In the illustrated embodiment, a setting angle $\beta$ of 60° is adopted as an especially preferable example.

The blow-off direction of air F ejected from the left and right boxes 36, 37 is directed inwardly to cross or intersect the blow-off direction of air F ejected from the central box 35, as shown in FIG. 5. This arrangement is effective to prevent the strippable paint from flowing outwardly beyond the area to be protected.

Figure 7:
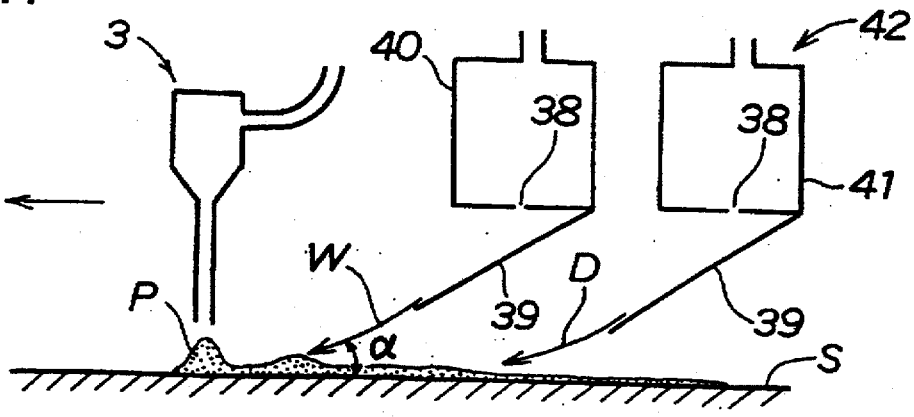
FIG. 7 is a diagrammatical view showing the positional relationship between the coating nozzle and an air blow-off unit of the two-stage construction used for blowing humid air and dehumidified air, separately.

In the case where the strippable paint used is of the type having a high viscosity or becomes dry easily, an air blow-off unit 42 such as shown in FIG. 7 is used, including a humidified air nozzle 40 for ejecting humidified air W and a dehumidified air nozzle 41 for ejecting dehumidified air D. By the use of humidified air W, the strippable paint P trickled on the coated surface S is spread out uniformly within the area to be protected and hence is reduced in thickness. Ejection of the humidified air W is followed by ejection of the dehumidified air D by means of which the strippable paint P is further spread out with an additional reduction in thickness and with accelerated drying of the strippable paint P, at the same time.

The protective film forming apparatus of the foregoing construction will operate to carry out the method of the invention for forming a protective film on a coated surface in a manner described below.

At first, a vehicle body 1 consisting of a coated entire car while being conveyed by the conveyor (not shown) is stopped at a position where only the hood A of the vehicle body 1 underlies the vertically movable frame structure 13. Upon stopping the vehicle body 1, the vertically movable frame structure 13 is lowered by the drive means (not shown) from its uppermost original position, as indicated by the chain lines shown in FIG. 2, while the longitudinally movable frame structure 20 carded on the vertically movable frame structure 13 is located at the rear or trailing end of the frame structure 13 as viewed from the advancing direction of the vehicle body 1. Downward movement of the vertically movable frame structure 13 is stopped when it arrives at a position where the coating nozzle 3 is located above the front end of the hood A with a predetermined space therebetween.

At this time, the coating nozzle 3 is disposed in its original position indicated by the chain lines in FIG. 1 which is in registry with a right side edge of the vehicle body 1. Then, the coating nozzle 3 is moved at a predetermined speed horizontally in the Y-axis direction toward a left side edge of the hood A while it is trickling or dripping the strippable paint P at a predetermined amount of discharge onto the hood A along the front end edge thereof. Subsequently, the motor 27 is energized to move the longitudinally movable frame structure 20 by a predetermined distance in a direction (indicated by the arrow shown in FIG. 6) opposite to the advancing direction of the vehicle body 1.

Simultaneously with this movement of the longitudinally movable frame structure 20, air F is ejected or blown at a predetermined air ejection angle $\alpha$ from the air blow-off unit 4 onto the coated surface S in a manner as shown in FIGS. 5 and 6, so that the strippable paint P trickled on the front end edge of the hood A is spread out within a protective-film forming area by the force or pressure of the blow-off air. The coating nozzle 3 while trickling the strippable paint P onto the left side edge of the hood A is then moved at the predetermined speed in the Y-axis direction toward the right side edge of the hood A. Subsequently, the longitudinally movable frame structure 20 is moved again by the motor 27 in the direction (indicated by the arrow shown in FIG. 6) opposite to the advancing direction of the vehicle body 1 over the predetermined distance.

Simultaneously with this movement of the longitudinally movable frame structure 20, the air blow-off unit 4 blows air F at the predetermined air ejection angle $\alpha$ onto the coated surface S in the manner shown in FIGS. 5 and 6 whereby the strippable paint P trickled on the hood A is forced to spread out within the protective-film forming area.

The foregoing cycle of operations is repeated until after the strippable paint P is spread over the entire part of the protective-film forming area of the hood A, whereupon the discharge of the strippable paint P from the coating nozzle 3 is stopped. Thereafter, ejection of air F from the air blow-off unit 4 is stopped, and in order to keep the strippable paint P from spreading out beyond a boundary of the protective-film forming area, the ejection angle of air F is changed such that air F blown from the air blow-off unit 4 will not impinge against the boundary of the protective-film forming area, When the strippable paint P coated on the hood A becomes dry, it forms a thin protective film of a uniform thickness extending over the entire area of the coated surface of the hood A.

In the case where the strippable paint P used is of the type having a high viscosity or dries easily, the resulting protective film is liable to become irregular in thickness or ruptured. To avoid this, humidified air W is blown from the humidified air nozzle 40 at a predetermined air ejection angle $\alpha$ relative to the coated surface S, as shown in FIG. 7, thereby forcing the strippable paint P to sufficiently spread out within the protective-film forming area, with a reduction in thickness. After the strippable paint P is spread by the humidified air W, dehumidified air D is blown from the dehumidified air nozzle 41 to effect additional spreading and thinning of the strippable paint P and thereby ensure accelerated drying of the strippable paint P.

In the case where a confined visual boundary is needed, a strippable paint may be coated on with a roller (100 mm in width) or a brush (50 mm in width) along the periphery of an area to be protected so as to provide an overlap or two-ply coating portion between the roll- or brush-coated film and the coating film formed by the protective film forming apparatus of this invention, thereby improving the aesthetical appearance of the visual boundary.

Likewise the hood A, the roof B and the trunk lid C is coated with a protective film of strippable paint, as will be described below.

When the coating of the hood A is completed, the vertically movable frame structure 13 is moved upward to its uppermost original position, and the vehicle body 1 is advanced by the conveyor to a position in which only the roof B underlies the vertically movable frame structure 13. Then, the vertically movable frame structure 13 is lowered by the drive means from its uppermost original position and, at the same time, the longitudinally movable frame structure 20 is moved in the advancing direction of the vehicle body 1. Movement of the frame structures 13, 20 is stopped when the coating nozzle 3 is located above the front end of the roof B with a predetermined space therebetween.

At this time, the coating nozzle 3 is disposed in its original position which is in registry with a right side edge of the vehicle body 1. Then, in the same manner as done with respect to the hood A, the coating nozzle 3 is moved at a predetermined speed horizontally in the Y-axis direction toward a left side edge of the roof B while trickling the strippable paint P at a predetermined amount of discharge onto the roof B along the front end edge thereof. Subsequently, the motor 27 is energized to move the longitudinally movable frame structure 20 in the direction opposite to the advancing direction of the vehicle body 1 over the predetermined distance.

Simultaneously with this movement of the longitudinally movable frame structure 20, the air blow-off unit 4 ejects air F at a predetermined air ejection angle $\alpha$ with respect to the coated surface S in the same manner as done with respect to the hood A, such as shown in FIGS. 5 and 6, so that the strippable paint P trickled on the front end edge of the roof B is spread out within a protective-film forming area.

When the roof B coating process is completed, the vertically movable frame structure 13 is moved upward and returns to its uppermost original position. Then, the vehicle body 1 is advanced by the conveyor to a position in which only the trunk lid C underlies the vertically movable frame structure 13. Subsequently, the vertically movable frame structure 13 is lowered from its uppermost original position by the drive means and, at the same time, the longitudinally movable frame structure 20 is moved in the advancing direction of the vehicle body 1. Movement of the frame structures 13, 20 is stopped when the coating nozzle 3 is located above the front end of the trunk lid C with a predetermined space therebetween.

The coating nozzle 3 and the air blow-off unit 4 cooperate to form a protective film of the strippable paint coated over the trunk lid C in the same manner as done with respect to the hood A and the roof B.

When coating of the trunk lid C is completed, the vertically movable frame structure 13 returns to its uppermost original position. Thereafter, the vehicle body 1 is discharged from the protective film forming apparatus by means of the conveyor. In the case where an article to be coated with a protective film, that is, the hood A, the roof B or the trunk lid C includes a certain degree of irregularity in shape and configuration, the coating nozzle 3 and the air blow-off unit 4 may be attached to an industrial robot to ensure that a protective film can be formed in conformity with the irregular shape and configuration of the article.

It is further possible to use another industrial robot and attach thereto the coating nozzle 3 and the air blow-off unit 4 for enabling that a protective film can be formed by two robots cooperating with each other.

INDUSTRIAL APPLICABILITY

As described above, according to the present invention, dust of the strippable paint is no longer generated, the strippable paint is prevented from adhering to a portion other than the area to be protected, and the need for a masking process and a process for inspection and correction or mending can be obviated. It is therefore possible to form a protective film with improved working efficiency and improved coating efficiency.

By the combination of trickling of the strippable paint by the coating nozzle and blowing of air from the air blow-off unit, the strippable paint can be uniformly coated over the coated surface without causing irregularities in thickness.

It appears from the foregoing that the present invention is extremely useful when applied in the coating industries concerned not only with the coating of vehicle bodies but also with the coating of other articles.

I claim:

1. A method of forming a protective film on a coated surface of a completed automobile body for temporarily protecting the coated surface, comprising the steps of:

a) applying a strippable paint onto the coated surface linearly along one side of a periphery of an area of the coated surface to be protected; and b) blowing air from above obliquely against the coated surface to which said strippable paint has been applied, for spreading said strippable paint over the area of the coated surface to be protected; and c) drying said spread strippable paint.

2. A method of forming a protective film on a coated surface according to claim 1, characterized in that said air is humidified air.

3. A method of forming a protective film on a coated surface, according to claim 2, characterized in that it further includes the step of blowing dehumidified air against the strippable paint which has been spread over said area of the surface to be protected.

4. A method of forming a protective film on a coated surface, according to claim 3, characterized in that it further includes the step of coating the strippable paint by a roller or a brush along the periphery of the area of the surface to be protected so as to form an overlap between a coating portion formed by the roller- or brush-coating step and a coating portion formed by said blowing step.

5. A method of forming a protective film on a coated surface, according to claim 2, characterized in that it further includes the step of coating the strippable paint by a roller or a brush along the periphery of the area of the surface to be protected so as to form an overlap between a coating portion formed by the roller- or brush-coating step and a coating portion formed by said blowing step.

6. A method of forming a protective film on a coated surface, according to claim 1, characterized in that it further includes the step of coating the strippable paint by a roller or a brush along the periphery of the area of the surface to be protected so as to form an overlap between a coating portion formed by the roller- or brush-coating step and a coating portion formed by said blowing step.

7. A method of forming a protective film on a coated surface, according to claim 1, characterized in that air is blown from above obliquely at an angle of 55 to 65 degrees against the surface to which the strippable paint is applied.

8. A method of forming a protective film on a coated surface, according to claim 7, characterized in that said angle is 60 degrees.

9. A method of forming a protective film on a coated surface, according to claim 1, characterized in that said air is blown from a left side, a right side, and a central side of the area of the surface to be protected in such a manner that streams of air blown from left and right sides are directed inwardly to cross streams of air blown from the central side.

10. A method of forming a protective film on a coated surface, according to claim 1, characterized in that it further includes the step of coating the strippable paint by a roller or a brush along the periphery of the area of the surface to be protected so as to form an overlap of coating on and along said periphery of the area of the surface to be protected.

11. An apparatus for forming a protective film on a coated surface of a completed automobile body for temporarily protecting the coated surface, comprising:

a) a coating nozzle reciprocally movable in a horizontal plane for applying a strippable paint onto the coated surface of the automobile body;

b) an air blow-off unit for blowing air obliquely against the coated surface of the automobile body for spreading said strippable paint which has been applied to the coated surface, in a direction substantially normal to the direction of reciprocal movement of said coating nozzle;

c) a horizontally movable frame structure carrying thereon said coating nozzle and said air blow-off unit and reciprocally movable in a horizontal plane in a direction normal to said direction of reciprocal movement of said coating nozzle; and d) a vertically movable frame structure carrying thereon said horizontally movable frame structure and reciprocally movable in a vertical direction.

12. An apparatus for forming a protective film on a coated surface, according to claim 11, characterized in that said air blow-off unit is composed of a central box, a left box, and a right box, said left and right boxes being directed inwardly such that streams of air blown respectively from said central box, said left box and said right box cross one another.

13. An apparatus for forming a protective film on a coated surface, according to claim 11, characterized in that said air blow-off unit includes an air nozzle for blowing humidified air and an air nozzle for blowing dehumidified air.

14. An apparatus for forming a protective film on a coated surface according to claim 13, characterized in that each of said air nozzles of said air blow-off unit has an open delivery end composed of a multiplicity of aligned holes.

15. An apparatus for forming a protective film on a coated surface, according to claim 11, characterized in that said air blow-off unit blows air at an angle of 55 to 65 degrees.

16. An apparatus for forming a protective film on a coated surface, according to claim 15, characterized in that said air blow-off unit blows air at an angle of 60 degrees.

17. An apparatus for forming a protective film on a coated surface, according to claim 11, characterized in that it further includes a roller or a brush for coating the strippable paint along a periphery of an area of the coated surface to be protected by said strippable paint so as to form a coated film overlapping, on and along said periphery of the area, with a coated film of strippable paint delivered from said coating nozzle.

* * * * *

UNITED STATES PATENT AND TRADEMARK OFFICE

CERTIFICATE OF CORRECTION

PATENT NO. : 5,686,145

DATED : November 11, 1997

INVENTOR(S) : Akasaka

It is certified that error appears in the above-identified patent and that said Letters Patent is hereby corrected as shown below:

In col. 2, line 8, change "at" to —to—.

Signed and Sealed this

Sixth Day of October, 1998

*Attest:*

*Attesting Officer*

BRUCE LEHMAN

*Commissioner of Patents and Trademarks*